US007059791B2

(12) United States Patent
Vandermeulen

(10) Patent No.: US 7,059,791 B2
(45) Date of Patent: Jun. 13, 2006

(54) TAPE PRINTER

(75) Inventor: Kris Vandermeulen, Bornem (BE)

(73) Assignee: DYMO, Sint-Niklaas (BE)

( * ) Notice: Subject to any disclaimer, the term of this patent is extended or adjusted under 35 U.S.C. 154(b) by 52 days.

(21) Appl. No.: 10/435,692

(22) Filed: May 9, 2003

(65) Prior Publication Data

US 2004/0055485 A1 Mar. 25, 2004

Related U.S. Application Data

(60) Provisional application No. 60/451,596, filed on Mar. 3, 2003.

(30) Foreign Application Priority Data

Sep. 19, 2002 (GB) ..... 0221765.1

(51) Int. Cl.
*B41J 3/24* (2006.01)

(52) U.S. Cl. ..... 400/613; 400/593; 400/613.1; 400/621

(58) Field of Classification Search ..... 400/611, 400/613, 613.1, 593, 621
See application file for complete search history.

(56) References Cited

U.S. PATENT DOCUMENTS 4,428,694 A * 1/1984 Ragen ..... 400/144.2
4,952,086 A * 8/1990 Yamaguchi ..... 400/223
6,068,187 A 5/2000 Momose
6,648,532 B1 * 11/2003 Furuya et al. ..... 400/621
6,705,784 B1 * 3/2004 Furuya et al. ..... 400/621
2001/0007503 A1 7/2001 Inana
2002/0066349 A1 6/2002 Furuya

FOREIGN PATENT DOCUMENTS

EP 0 592 198 A3 4/1996
EP 0 641 663 A3 1/1998

* cited by examiner

*Primary Examiner*—Andrew H. Hirshfeld
*Assistant Examiner*—Kevin D. Williams
(74) *Attorney, Agent, or Firm*—Winston & Strawn LLP

(57) ABSTRACT

A pinion wheel for a spitter mechanism of a tape printer includes a first surface that does not engage with a tape, and a second surface for contact with a portion of the tape. Rotation of the pinion wheel causes the second surface to engage and move the portion of tape. In an implementation, the first surface has a first curvature and the second surface has a second curvature. The first surface may be flat and the second surface may be arcuate. In another implementation, a tape printer includes a printer body, a printing means, a cutting means for cutting a tape, and a spitter mechanism for moving a portion of the tape. The spitter mechanism includes an element rotatable between a first position and a second position. In the first position, a first surface does not engage the portion of tape, and in the second position a second surface engages the portion of tape. Rotation of the element to the second position causes the portion of tape to be moved.

20 Claims, 8 Drawing Sheets

TAPE PRINTER

CROSS-REFERENCE TO RELATED APPLICATIONS

This application claims the benefit of U.S. Provisional Patent application 60/451,596 filed on Mar. 3, 2003, the entire content of which is expressly incorporated herein by reference thereto.

FIELD OF THE INVENTION

The present invention relates to a tape printer.

BACKGROUND OF THE INVENTION

Tape printers are known which use a supply of tape, housed in a cassette received in the tape printer. The tape comprises an image receiving layer and a backing layer which are secured to one another via an adhesive layer. Such tape printers include a cutting mechanism for cutting off a portion of the tape after an image has been printed onto the image receiving layer so that the portion of tape having the image can be used as a label. After the tape has been cut, the cut portion of the tape is pulled from the printer through a slit in the printer housing. The backing layer can then be removed allowing the image receiving layer to be secured to an object using the adhesive layer.

A problem with known arrangements is that after the cutting step, the cut portion of tape must be removed manually from an exit in the body of the printer. If many labels are required to be printed then having to remove each individual label from the printer can be time consuming. Also, if the tape printer is remote from the data input device, for example a tape printer with a personal computer (PC), then a user may have to get up from the PC and walk to the printer and remove the label from the printer before returning to the PC to actuate another printing cycle. If the labels are not removed between printing cycles then the cut portions can jam the mechanism either at the exit, or further back upstream at the cutter mechanism or the printing mechanism. Newly printed sections of tape may be fed into different portions of the device rather than out through the exit, thus clogging the mechanism.

A second problem with prior arrangements is that if a short label is printed, the cut portion may not be of sufficient length to protrude through the exit in the body of the printer. It is then difficult to remove the cut portion manually. The cut portion may get stuck within the printer body blocking the tape path and leading to the mechanism becoming clogged.

It is an aim of the embodiment described hereinafter to solve the problems outlined above.

SUMMARY OF THE INVENTION

Presented is a pinion wheel for a spitter mechanism of a tape printer. The pinion wheel includes a first surface that does not engage with a tape, and a second surface for contact with a portion of the tape. Rotation of the pinion wheel causes the second surface to engage and move the portion of tape out of the tape printer.

The invention may include one or more of the following features. The first surface of the pinion wheel may have a first curvature and the second surface may have a second, different curvature. For example, the first surface may be flat and the second surface may be arcuate. The pinion wheel may include a protrusion for contacting a home switch of the spitter mechanism.

Another implementation of the invention pertains to a spitter mechanism for moving a portion of a tape in a tape printer. The spitter mechanism includes an element having a first surface facing a tape passageway when in a first position, and having a second surface facing the tape passageway when rotated to a second position. The spitter mechanism also includes a motor for rotating the element from the first position, wherein the first surface is not engaged with the portion of tape, to the second position wherein the second surface engages with the portion of tape to cause the portion of tape to be moved.

The spitter mechanism may include one or more of the following features. The first surface of the element may have a first curvature and the second surface may have a second, different curvature. Furthermore, the first surface may be flat and the second surface may be arcuate. The spitter mechanism may include a controller for generating a signal to actuate the spitter mechanism, and may include a home switch for detecting a home position.

According to another aspect of the present invention, there is provided a tape printer including: a printer body housing a tape receiving portion for receiving a supply of tape on which an image is to be printed; printing means for printing an image on said tape; cutting means for cutting said tape; and a spitter mechanism for moving a portion of said tape, wherein said spitter mechanism comprises an element having a surface, said element being rotatable between a first position and a second position, wherein in said first position said surface is not engaged with the portion of tape and in said second position said surface is engaged with the portion of tape whereby rotation of said element in said second position causes the portion of tape to be moved.

The spitter mechanism may be located downstream of the cutting means whereby in said second position said surface is engaged with a cut portion of tape thereby moving said cut portion of tape.

Generally, the portion of tape is moved out of an exit in the printer body.

The surface may have a first portion having a first curvature and a second portion having a second, different curvature, whereby in the first position the first portion is adjacent the portion of tape and in the second position the second portion is adjacent the portion of tape with the surface engaging the portion of tape.

The first portion may be flat and the second portion may be arcuate.

The printer may further include a controller for sending a signal to actuate the spitter mechanism after the cutting means has cut the image receiving tape.

The spitter mechanism may further include a home switch, for detecting a home position for the spitter mechanism.

Movement of the surface may be by an electric motor.

In one implementation, a plurality of spitter mechanisms are provided.

According to yet another aspect of the present invention there is provided a method of ejecting a cut portion of tape from a tape printer. The method includes rotating a pinion wheel of a spitter mechanism from a first position, wherein a first surface does not engage with the tape, to a second position wherein a second surface engages with the tape, and moving the cut portion of the tape with the second surface to eject the cut portion of the tape from the tape printer.

The method may include utilizing a pinion wheel having a first surface with a first curvature and a second surface with a second curvature. The first surface may be flat and the second surface may be arcuate.

BRIEF DESCRIPTION OF THE DRAWINGS

For a better understanding of the present invention and to show how the same may be carried into effect reference will now be made by way of example to the accompanying drawings.

Like reference numbers in the various drawings indicate like elements.

DETAILED DESCRIPTION OF THE PREFERRED EMBODIMENTS OF THE INVENTION

An embodiment of a printer according to the present invention will now be described with reference to FIGS. 1 to 7.

Figure 1:
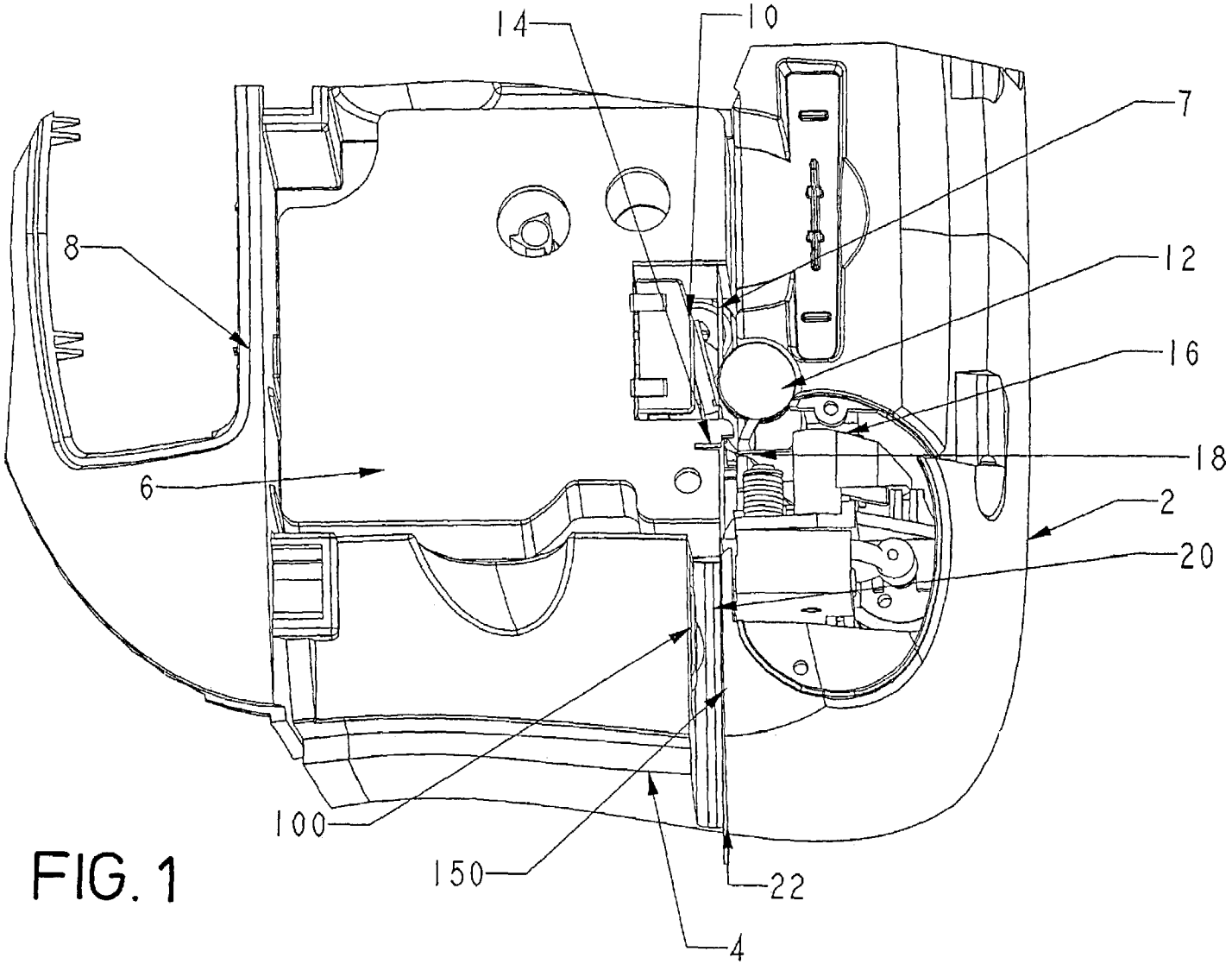
FIG. 1 is a top perspective view of a tape printer comprising a spitter mechanism in a first position.

FIG. 1 shows a portion of an embodiment of a printer according to the present invention. The printer 2 has a printer body 4 housing the constituent parts of the printer 2. A tape cassette 6 housing a tape 7 is positioned in a cassette receiving portion 8 of the printer 2. Printing means are provided comprising a printhead 10 and a platen 12, the print head 10 located on a moveable arm in a recess formed by the cassette 6. The cassette 6 comprises a slit 14 in a wall thereof, the tape 7 passing along a side of said wall past the slit 14. The printer has a cutter 16 on an opposite side of the tape to said cassette wall with a blade 18 situated opposite the slit 14. The printer body 4 defines a path 20 along which the tape may pass to a slot 22 in an outer portion of the body of the printer whereby the tape exits the printer. Downstream of the printing and cutter mechanisms, a spitter mechanism 100 is provided for feeding a cut portion of said tape through the slot 22 in the printer body 4. FIG. 1 shows a view of the printer during the printing procedure. The spitter 100 is in a first position in which the spitter 100 is disengaged from the tape. In this position, the tape from the cassette is free to move along the path 20 driven by the platen 12 during printing.

The print head may be a thermal print head comprising a column of a plurality of printing elements. The print head may be only one element wide and the column extends in a direction perpendicular to the lengthwise extent of the image receiving tape. The height of the column of printing elements may be equal to the width of the image receiving tape to be used with the tape printing apparatus. With embodiments of this invention, where more than one width of image receiving tape is used, the print head column will generally have a height suitable for printing on the largest width of tape.

During printing, the print head and the platen engage the tape. The platen rotates to drive the tape past the print head. An image is printed on the image receiving tape column by column by the print head. After printing, the cutter mechanism operates automatically or is operated by a user to cut the tape. During cutting the cutter blade passes through the tape and into the slit in the cassette wall cutting off the portion of tape having the printed image thereon.

Figure 2:
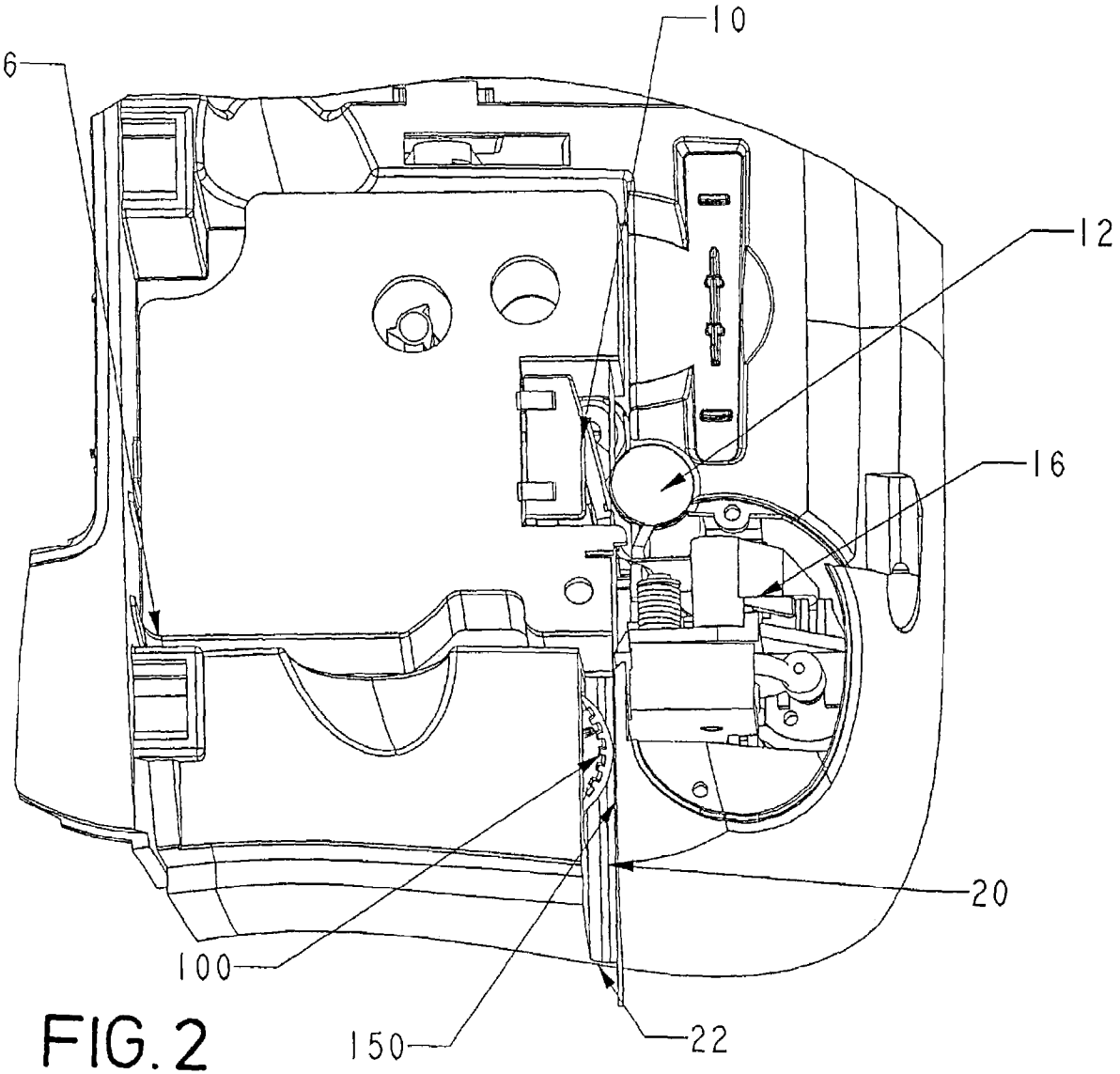
FIG. 2 is a top perspective view of the tape printer of FIG. 1, with the spitter mechanism in a second position.

FIG. 2 shows a view of the printer after printing and cutting. The spitter 100 can be seen engaging the cut portion of tape to eject it from the slot exit in the body of the printer.

Figure 3:
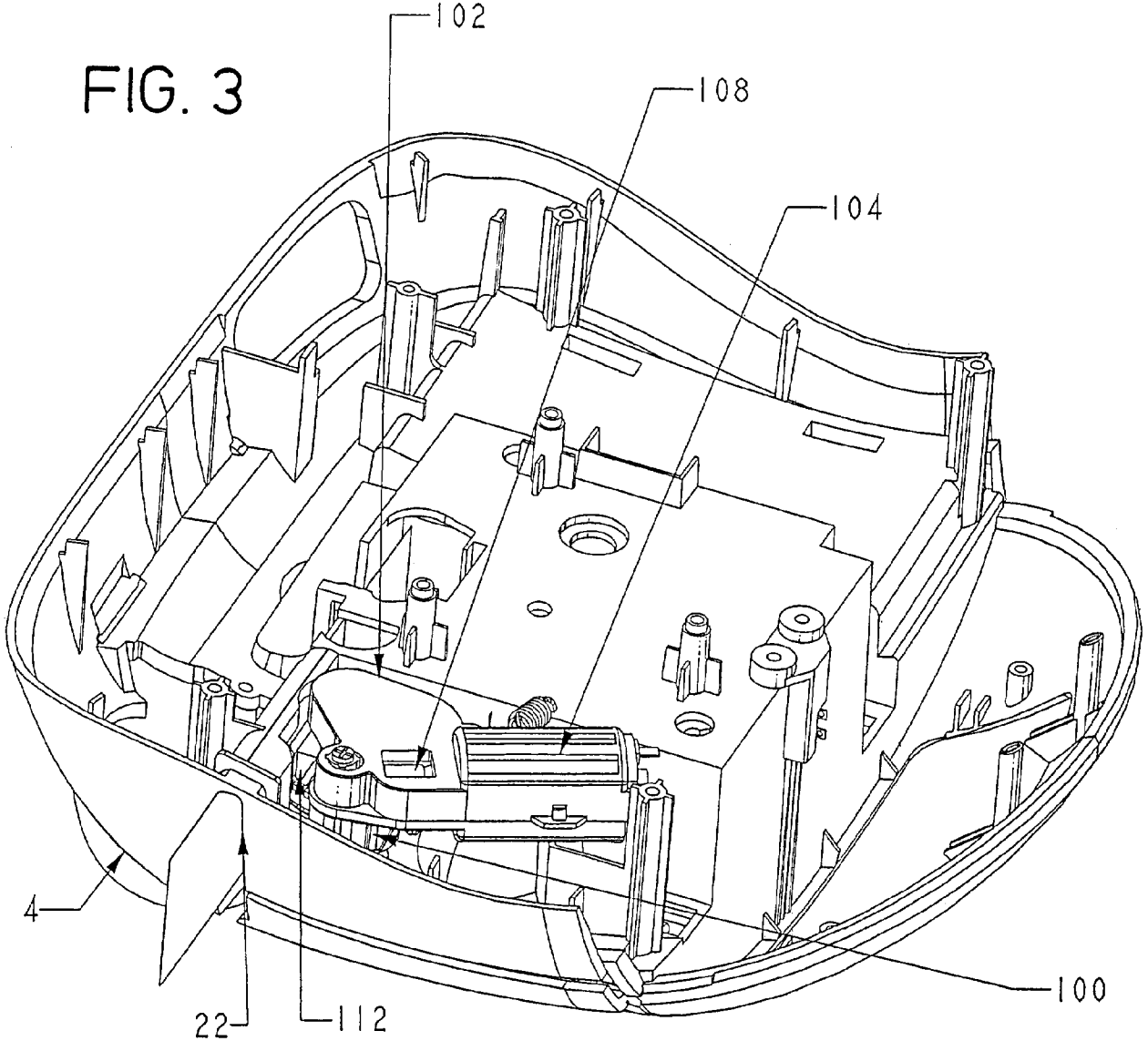
FIG. 3 is a bottom perspective view of the tape printer comprising the spitter mechanism with the bottom casing of the printer removed for clarity.
Figure 4:
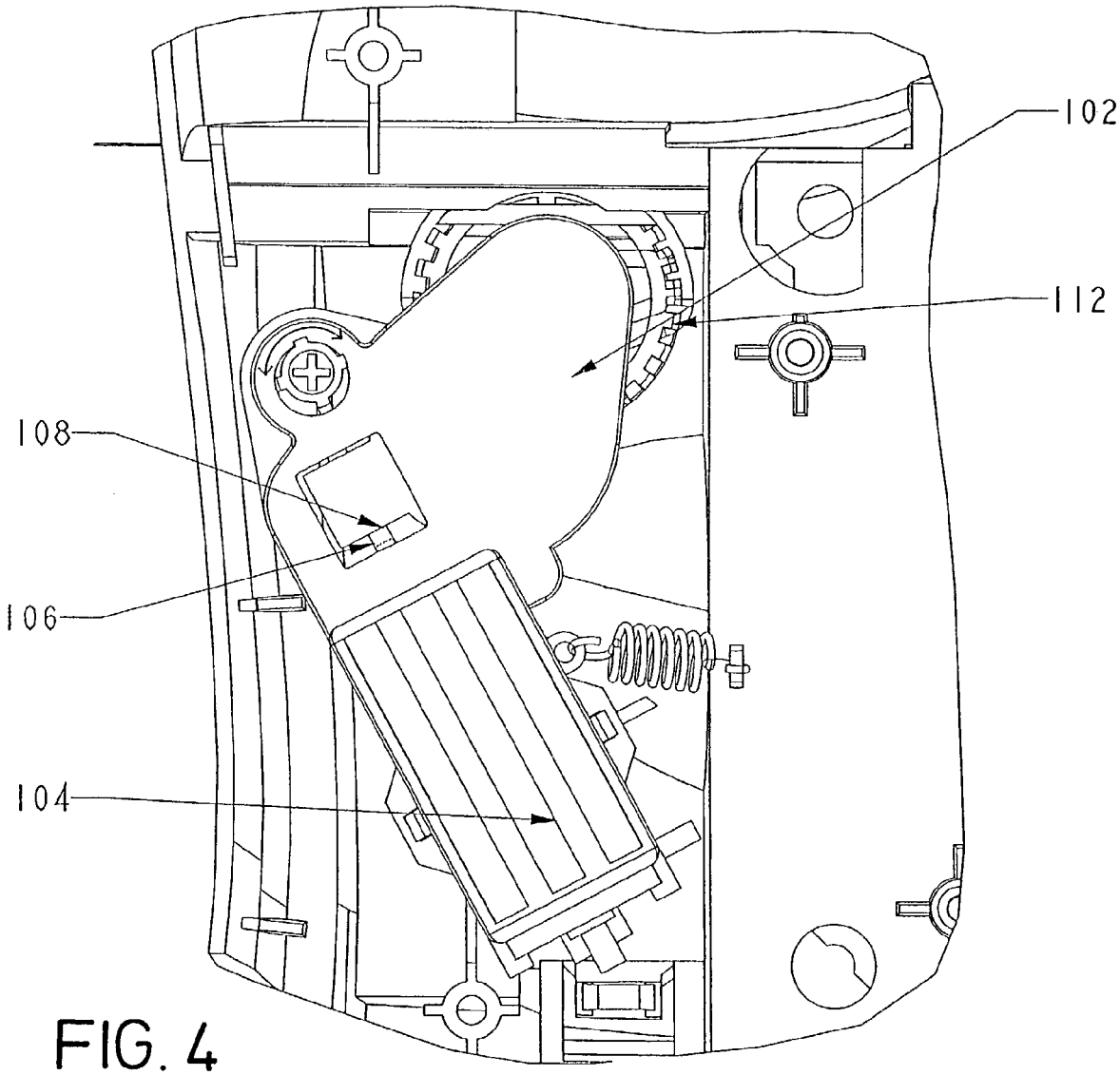
FIG. 4 is a bottom plan view of the tape printer comprising spitter mechanism with the bottom casing removed for clarity.

FIGS. 3 and 4 are views of the top casework of the printer from a bottom side showing the spitter mechanism 100 incorporated therein. The spitter mechanism is fitted into the upper casework of the body of the printer. An under side of the spitter is visible showing a bottom frame 102 on which the other elements of the mechanism are mounted thereon. Also visible in these Figures is an electric motor 104 which drives the mechanism, and a portion of the rotatable pinion wheel 112 which engages the tape thereby feeding the tape through the slot exit in the printer body during operation of the mechanism. Also visible is a worm 108 on the drive shaft 106 of the motor which comprises part of the drive mechanism for rotating the pinion wheel 112.

Figure 5:
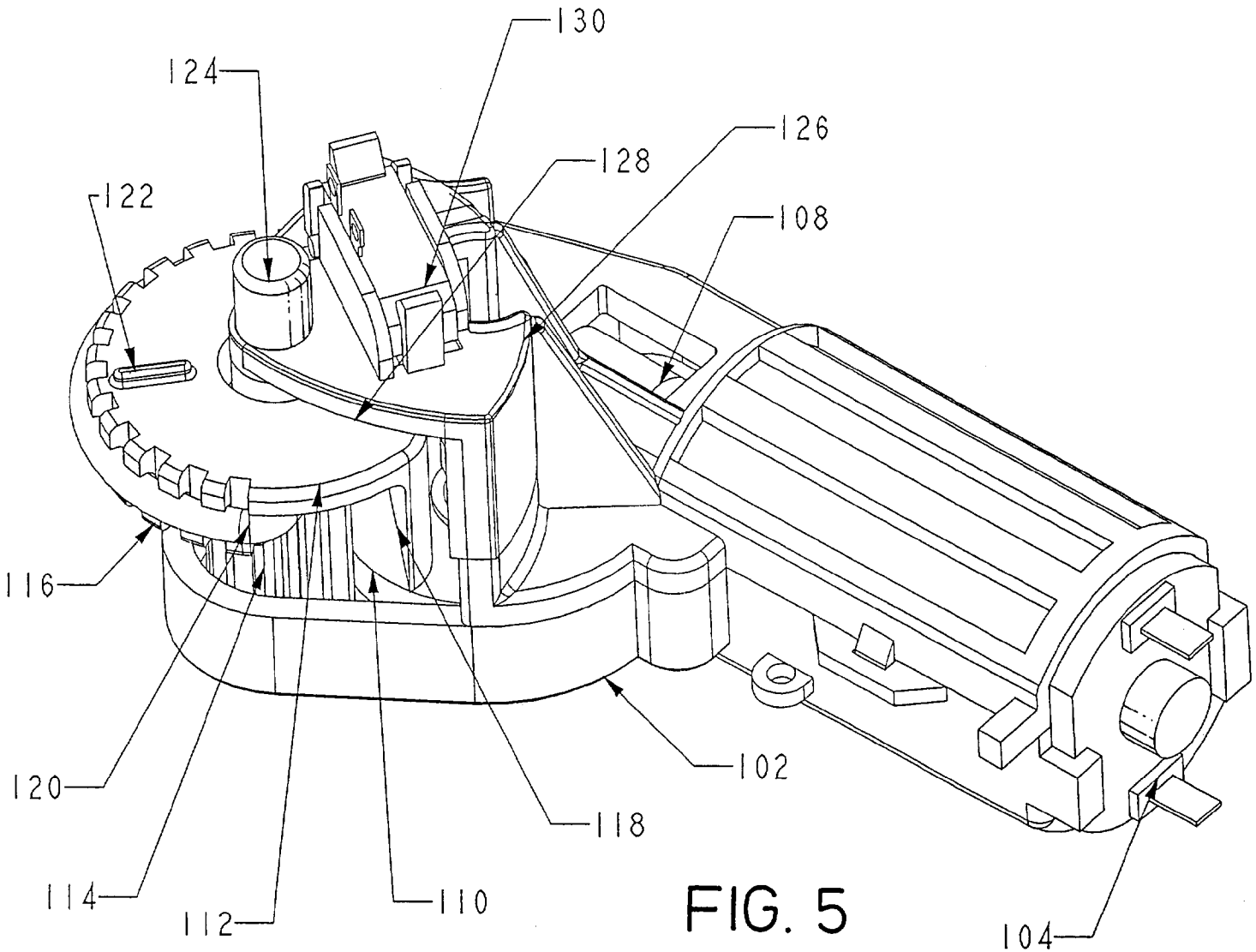
FIG. 5 is perspective view showing the spitter mechanism in more detail.

FIG. 5 shows the spitter mechanism in more detail. The mechanism comprises the bottom frame 102, shown in FIGS. 3 and 4 from an under side, on which the other elements of the mechanism are mounted. The electric motor 104 drives the mechanism. The motor 104 has a drive shaft 106 with the worm 108 thereon. The worm 108 is coupled to a first gear 110 which is in turn coupled to a pinion wheel 112.

The pinion wheel 112 has a lower portion which comprises a gear 114 to which the first gear 110 is coupled. The pinion wheel has an upper portion comprising an arcuate portion 116 and a flat portion 118. The arcuate portion 116 of the embodiment of FIG. 5 is semi-circular. The arcuate portion 116 has a rubber o-ring 120 thereon. Note that some of the elements discussed in the following are shown more clearly in FIG. 6, and are not labeled in FIG. 5. The upper portion has a flat upper surface with a rib 122 and a central cylindrical cavity (not visible) which runs the axial length of the pinion wheel 112. A shaft 124 passes up from the bottom frame 102 through the cavity, and the pinion wheel 112 is rotatable around said shaft 124. A top frame 126 extends upwardly from the bottom frame 102 and has an upper portion 128 which extends over the upper surface of the pinion wheel 112. The upper portion of the top frame 128 is connected to an upper portion of the shaft 124 which passing up through the center of the pinion wheel 112 to provide a secure structure. A home switch 130 is mounted on the upper portion of the top frame 128. The rib 122 on the upper surface of the pinion wheel 112 activates the home switch 130 to detect the home position of the spitter mechanism.

Figure 6:
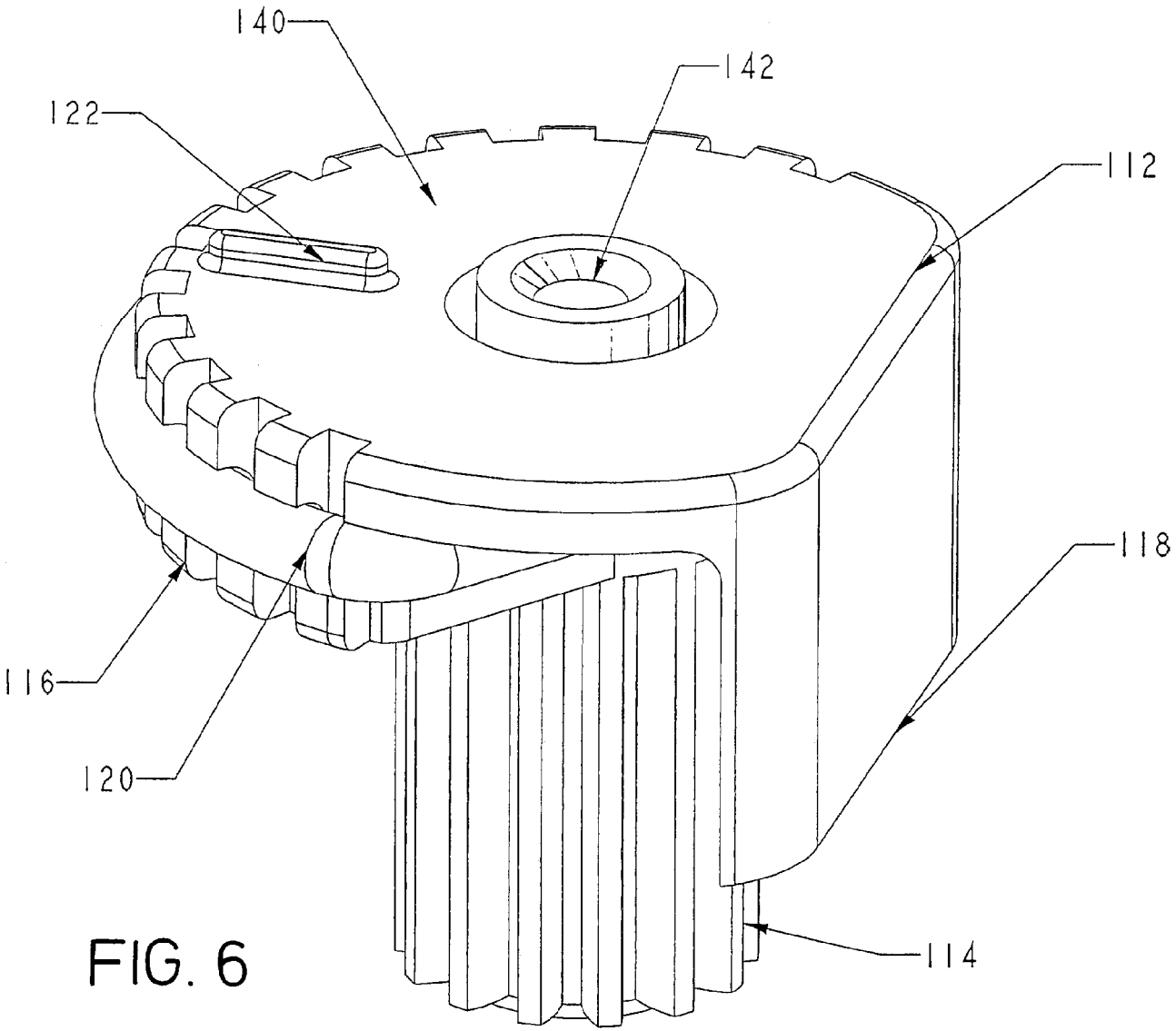
FIG. 6 is a perspective view of the pinion wheel of the spitter mechanism.
Figure 7:
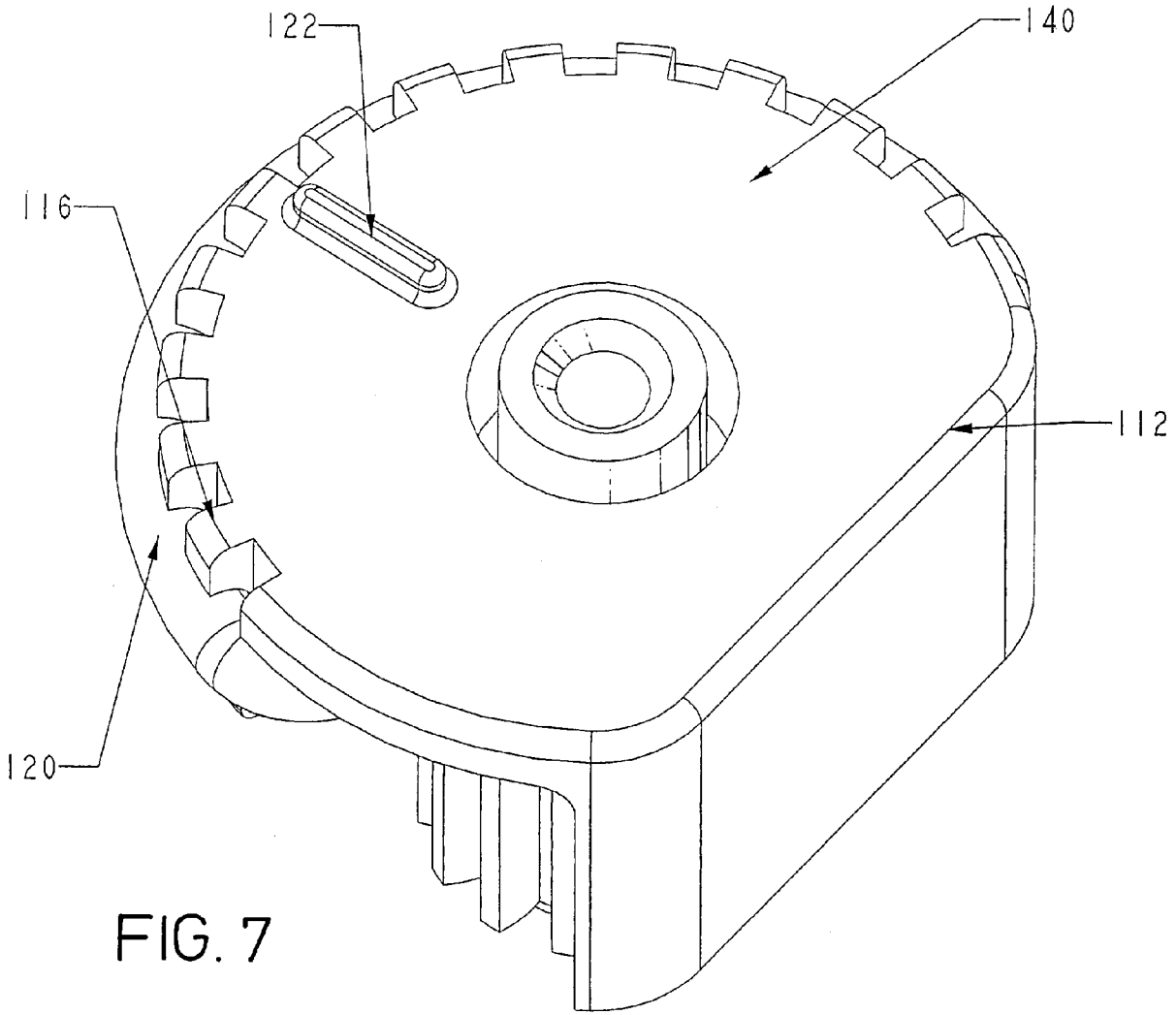
FIG. 7 is a perspective view of an upper portion of the pinion wheel of the spitter mechanism.

FIGS. 6 and 7 show the features of the pinion wheel of FIG. 5 in more detail. The pinion wheel has a lower portion comprising a gear 114 to which the first gear 110 is coupled and an upper portion comprising an arcuate portion 116 and a flat portion 118. The arcuate portion 116 has a rubber o-ring 120 thereon. In this embodiment the rubber o-ring has an active portion (i.e. the portion contactable with the tape) over about 180 degrees of the circumference of the pinion wheel. The upper portion has a flat upper surface 140 with a rib 122 and a central cylindrical cavity 142 which runs the axial length of the pinion wheel.

Operation of the spitter mechanism will now be described. In the start position the pinion wheel has its flat surface directed towards the tape path defined in the body structure. During printing tape from the cassette is fed between the printhead and the platen, the platen rotating to drive the tape through the printing mechanism and past the cutting mechanism. The tape passes along the path defined in the body of the printer. When printing has ceased the cutter mechanism is operable to cut the tape. After cutting off the printed portion of the tape the spitter mechanism is operated. In one embodiment the spitter mechanism may operate automatically after the tape has been cut. This embodiment is described in more detail below. In another embodiment the spitter mechanism may be actuated by a user. This may be achieved by providing a suitable button or key on the printer, or alternatively, the spitter may be actuated from a data input device such as a PC which is remote from the printer.

In the automatic embodiment, after cutting a signal is sent to the spitter to actuate the motor of the spitter. The signal may be sent directly from the cutter or from a central processor. The motor rotates the drive shaft with the worm thereon. The worm rotates the first gear which in turn rotates the pinion wheel. As the pinion wheel rotates the arcuate portion passes into the path defined in the body of the printer and contacts the cut portion of tape. The cut portion of tape is held between the rubber o-ring on the arcuate portion of the pinion wheel and a surface 150 (see FIGS. 1 and 2) on an opposite side of the path to the pinion wheel. The rubber o-ring has a higher coefficient of friction than the opposite surface 150, and as the pinion wheel rotates the o-ring grips the tape moving it in a direction along the path towards the tape-exit. The cut portion of tape is thus fed through the tape-exit which comprises a slot in the outer casing causing the cut portion to be "spat" out of the printer.

On further rotation of the spitter, the arcuate portion disengages from the tape and moves out of the tape path. On rotating 360 degrees the spitter is in its home position in which the flat portion of the pinion wheel is directed towards the tape path. The rib on the upper surface of the pinion wheel activates the home switch 130 which detects the home position and causes the mechanism to stop thus completing a spitter cycle.

Although a preferred embodiment of a spitter mechanism according to the present invention has been described, other embodiments within the scope of the invention are envisaged. For example, the surface 150 may be replaced with a roller or another spitter. This could reduce the friction on the tape and the contacting surfaces.

Figure 8:
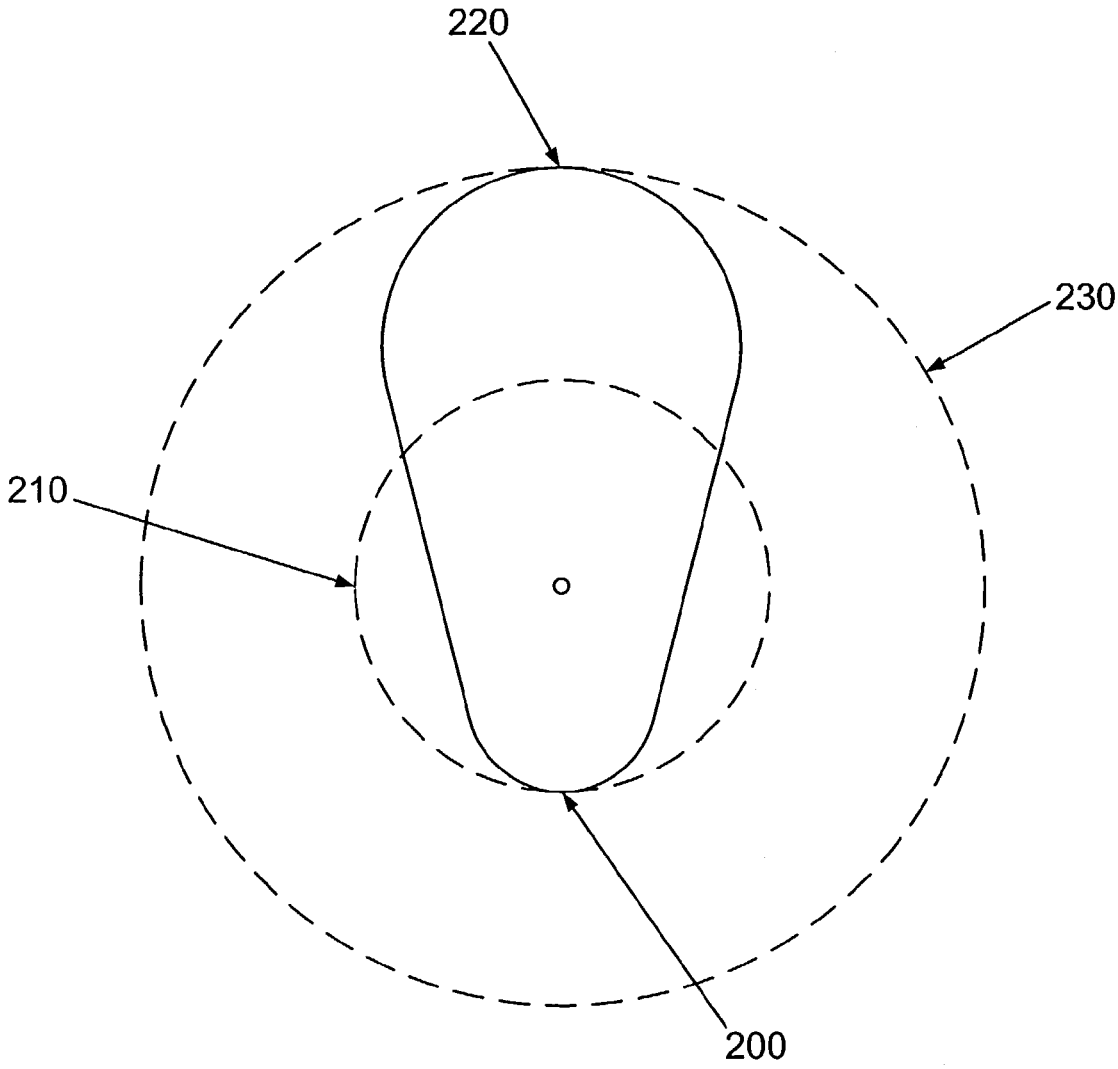
FIG. 8 is a plan view of another embodiment of a rotatable element of a spitter element.

Further, although the rotatable element of the described embodiment has a surface with an arcuate portion and a flat portion, this is not the only possibility envisaged. An important feature of the rotatable element is that it has a surface having a first portion which on rotation of the element follows and defines a first circular path, and a second portion which on rotation of the element follows and defines a second circular path and wherein the first circular path is wholly within the second circular path. Thus, the second portion extends further from the center of rotation of the element than the first portion. Because of this, when the first portion is adjacent the tape the surface does not reach and contact the tape whereas when the second portion is adjacent the tape the surface reaches and contacts the tape whereby the tape is moved on further rotation of the element. Of course the first portion does not have to be flat for the invention to be achieved but merely to be shorter than the distance between the fulcrum/center of rotation and the tape, the second portion being as long or longer than the distance between the fulcrum and the tape. Another embodiment of a rotatable element is shown in FIG. 8 having a surface with a first portion 200 which follows and defines a first circular path 210, and a second portion 220 which follows and defines a second circular path 230, said first circular path being wholly within said second circular path.

According to another possibility, a spitter may be provided along the tape path prior to a cutter. In such an arrangement the spitter functions to feed the tape from the printing mechanism to the cutting mechanism. Such an arrangement can help to prevent the tape from deviating from a preferred path and thus prevent the tape from clogging the various mechanisms in the printer. In fact, one or more spitters can be arranged at any number of positions along a tape path within a tape printer to feed and direct the tape. Further, one or more spitters may be provided in a printer which houses a plurality of tape cassettes/tape supplies. In such an embodiment the one or more spitters may act to feed and direct one or more tapes in one or more desired directions.

What is claimed is:

1. A tape printer spitter mechanism for moving a portion of tape in a tape printer comprising:

an element having an external surface with a first portion of a first configuration facing a tape passageway when in a first angular position about an axis of rotation, and a second portion of a second different configuration facing the tape passageway when rotated to a second angular position about the axis of rotation, wherein the first and second portions are angularly displaced from each other about the axis of rotation;

a motor for rotating the element about the axis of rotation from the first angular position, wherein the first portion is not engaged with the portion of tape, to the second angular position wherein the second portion engages with the portion of tape to cause the portion of tape to be moved; and a home switch for detecting a home position and wherein the element further comprises a protrusion for contacting the home switch.

2. A spitter mechanism according to claim 1, wherein the second portion has an arcuate curvature.

3. A spitter mechanism according to claim 1, wherein the first portion is flat and the second portion is arcuate.

4. A spitter mechanism according to claim 1, further comprising a controller for generating a signal to actuate the spitter mechanism.

5. A tape printer comprising:

a printer body housing a tape receiving portion for receiving a supply of tape on which an image is to be printed;

a printing member configured for printing an image on said tape;

a cutting member configured for cutting said tape; and a spitter mechanism for moving a portion of said tape, wherein said spitter mechanism comprises an element having a surface, said element being rotatable between a first angular position about an axis of rotation and a second angular position about the axis of rotation, wherein in said first angular position said surface is not engaged with the portion of tape and in said second angular position said surface is engaged with the portion of tape, whereby rotation of said element in said second angular position causes the portion of tape to be moved, wherein said surface has a first portion having a first configuration and a second portion that is angularly displaced from the first portion about the axis of rotation and has a second configuration different from the first configuration, whereby in said first angular position said first portion is adjacent the portion of tape and in said second angular position said second portion is adjacent the portion of tape with said surface engaging the portion of tape.

6. A tape printer according to claim 5, wherein said spitter mechanism is located downstream of the cutting member whereby in said second position said surface is engaged with a cut portion of tape thereby moving said cut portion of tape.

7. A tape printer according to claim 5, wherein said portion of tape is moved out of an exit in the printer body.

8. A tape printer according to claim 5, wherein said second portion has an arcuate curvature.

9. A tape printer according to claim 5, wherein said first portion is flat and said second portion is arcuate.

10. A tape printer according to claim 5, wherein the printer further comprises a controller for sending a signal to actuate the spitter mechanism after the cutting member has cut the image receiving tape.

11. A tape printer according to claim 5, wherein the spitter mechanism further comprises a home switch, for detecting a home position for the spitter mechanism.

12. A tape printer according to claim 5, wherein movement of said surface is by an electric motor.

13. A tape printer according to claim 5, wherein a plurality of spitter mechanisms are provided.

14. A method of ejecting a cut portion of tape from a tape printer comprising:

providing a cut portion of tape;

rotating a pinion wheel of a spitter mechanism about an axis of rotation from a first angular position to a second angular position, in which a first surface of the pinion wheel of a first configuration faces but does not engage with the cut tape portion, to a second position in which a second surface of the pinion wheel faces and engages the tape portion, wherein the second surface is angularly displaced from the first surface about the axis of rotation and that has a second, different configuration than the first surface; and moving the cut tape portion with the second surface in the second angular position to eject the cut tape portion from the tape printer.

15. A method according to claim 14, which further comprises providing the second surface with an arcuate curvature, wherein the rotation of the pinion wheel engages the curvature of the second surface with the tape.

16. A method according to claim 14, wherein the first surface is flat and the second surface is arcuate.

17. A tape printer spitter mechanism for moving tape in a tape printer comprising:

a tape passageway configured to receive the tape;

a spitter element having an axis of rotation and a surface that includes:

a first portion disposed radially from the axis at a first distance, and a second portion disposed radially from the axis at a second distance that is greater than the first distance, the second portion being angularly displaced from the first portion about the axis, wherein the spitter element is rotatable about the axis between:

a first position in which the first portion faces the tape in the tape passageway, and the second portion is disengaged from the tape, and a second position in which the second portion faces the tape in the passageway and is engaged with the tape to move the tape upon rotation of the spitter element, and wherein the first distance is sufficiently small so that the first portion is disengaged from the tape in the tape passageway in both the first and second positions; and a motor operably associated with the spitter element to rotate the spitter element through the first and second positions.

18. The spitter mechanism according to claim 17, wherein the second portion is semicircular.

19. The spitter mechanism according to claim 18, wherein the first portion is configured to be disengaged from the tape in the passageway throughout the entire rotation of the spitter element.

20. A tape printer, comprising the spitter mechanism of claim 17.

* * * * *